US007938185B2

(12) United States Patent
Smith et al.

(10) Patent No.: US 7,938,185 B2
(45) Date of Patent: May 10, 2011

(54) FRACTURE STIMULATION OF LAYERED RESERVOIRS

(75) Inventors: Philip S. Smith, Houston, TX (US); Howard William MacDonald, Ho Chi Minh (VN); Jose Ignacio Rueda G., Katy, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 12/114,231

(22) Filed: May 2, 2008

(65) Prior Publication Data

US 2008/0271890 A1 Nov. 6, 2008

Related U.S. Application Data

(60) Provisional application No. 60/916,025, filed on May 4, 2007.

(51) Int. Cl.
*E21B 43/267* (2006.01)

(52) U.S. Cl. ..... 166/280.1; 166/271; 166/308.1

(58) Field of Classification Search ..... None
See application file for complete search history.

(56) References Cited

U.S. PATENT DOCUMENTS

| | | | | |
|---|---|---|---|---|
| 3,592,266 | A * | 7/1971 | Tinsley | 166/283 |
| 3,933,205 | A * | 1/1976 | Kiel | 166/308.1 |
| 4,186,802 | A | 2/1980 | Perlman | |
| 4,993,491 | A * | 2/1991 | Palmer et al. | 166/280.1 |
| 5,018,578 | A | 5/1991 | El Rabaa et al. | |
| 5,890,536 | A | 4/1999 | Nierode et al. | |
| 6,186,230 | B1 | 2/2001 | Nierode | |
| 6,394,184 | B2 | 5/2002 | Tolman et al. | |
| 6,520,255 | B2 | 2/2003 | Tolman et al. | |
| 6,543,538 | B2 | 4/2003 | Tolman et al. | |
| 6,672,405 | B2 | 1/2004 | Tolman et al. | |
| 6,776,235 | B1 * | 8/2004 | England | 166/271 |
| 6,957,701 | B2 | 10/2005 | Tolman et al. | |
| 7,059,407 | B2 | 6/2006 | Tolman et al. | |
| 7,066,266 | B2 | 6/2006 | Wilkinson | |
| 7,096,954 | B2 | 8/2006 | Weng et al. | |
| 7,287,596 | B2 | 10/2007 | Frazier et al. | |
| 7,343,975 | B2 | 3/2008 | Surjaatmadja et al. | |
| 2004/0199329 | A1 * | 10/2004 | Stone | 702/13 |
| 2006/0113077 | A1 * | 6/2006 | Willberg et al. | 166/280.1 |

* cited by examiner

*Primary Examiner* — Zakiya W. Bates
(74) *Attorney, Agent, or Firm* — Albert K. Shung

(57) ABSTRACT

A hydraulic fracturing process consisting essentially of drilling a wellbore through at least one reservoir formation, installing in said wellbore at least one conduit, ensuring pressure communication between said wellbore and said reservoir formation, at a higher effective stress formation, selecting the location of the pressure communication between the wellbore and the reservoir formation for control of said hydraulic fracturing process and pumping a hydraulic fracturing treatment comprising a fracturing fluid and a proppant, at a sufficient pressure via said conduit to create at least one fracture in the higher effective stress formation. In addition, processes for increasing conductivity near a wellbore and producing fluids from a lower effective stress permeable formation via a fracture extending from the higher effective stress fracture formation into the lower effective stress permeable formation may include applying several approaches to packing or filling fractures with proppant.

25 Claims, 5 Drawing Sheets

FRACTURE STIMULATION OF LAYERED RESERVOIRS

CROSS-REFERENCE TO RELATED APPLICATIONS

This application is entitled to and hereby claims the benefit of U.S. provisional application Ser. No. 60/916,025 entitled "Fracture Stimulation of Layered Reservoirs", filed May 4, 2007 on behalf of Philip S. Smith, Jose I. Rueda and Howard MacDonald.

FIELD OF THE INVENTION

In many subterranean formations, the permeability of the formation material is low and permits the flow of fluids from the formation only slowly, if at all. Hydraulic fracturing is one technique used to increase fluid flow from such formations.

BACKGROUND OF THE INVENTION

Well stimulation operations are designed to increase the production of crude oil and natural gas from wells penetrating subterranean areas containing crude oil, natural gas or both. The key goal of well stimulation is to increase the productivity of a well by removing damage in the vicinity of the wellbore or by superimposing a highly conductive structure onto the subterranean formation. One commonly used stimulation technique is hydraulic fracturing.

Conventional hydraulic fracturing is generally applied by directly treating the 'pay zone' of interest, and by using a fracturing fluid that can suspend the proppant until the fracture closes with at least a portion of the proppant in the fracture.

As used herein, "pay zone" is a term used to describe a reservoir formation that contains crude oil and/or natural gas intended to be produced from a wellbore.

The reservoir formations that are typically pay zones include sandstone, limestone, chalk, coal and some types of shale. Pay zones can vary in thickness from less than one foot (0.3048 m) to hundreds of feet (hundreds of m). The permeability of the reservoir formation provides the potential for production.

As used herein, the term "permeability" refers to "the capability of a porous rock or sediment to permit the flow of fluids through its pore spaces". The term "impermeable", as used herein, refers to porous substances not permitting the passage of a fluid through the pores interstices". (The Webster's New Universal Unabridged Dictionary, Barnes and Noble Books, 1996).

The term "effective stress level" refers to the average effective stress level in a formation. The term "higher effective stress" refers to an average effective stress level in a first formation which is greater than the average effective stress level in a second formation. The term "lower effective stress" refers to an average effective stress level in a first formation which is less than the average effective stress level in a second formation. Lower effective stress formations typically, but not always, are permeable formations Hydraulic fracturing is used to create fractures that extend from the well bore into reservoir formations so as to stimulate the potential for production. A fracturing fluid, typically viscous, is generally injected into the formation with sufficient pressure to create and extend a fracture, and a proppant is used to "prop" or hold open the created fracture after the hydraulic pressure used to generate the fracture has been released. When pumping of the treatment fluid is finished, the fracture "closes". Loss of fluid to permeable rock results in a reduction in fracture width until the proppant supports the fracture faces.

When fracturing a multi-layered reservoir comprising both permeable and impermeable layers, fluid loss (from the fracture to the reservoir formations) occurs in the permeable layers. When pumping of the treatment fluid is stopped, fluid moves away from the impermeable (typically higher effective stress) layers, and "fluid loss" occurs in the permeable (typically lower effective stress) layers as the pressure declines and the fracture closes. When viscous fluids are used, this fluid movement tends to also carry proppant away from the impermeable (typically higher effective stress) layers. When the fracture closes, the retained fracture conductivity in the impermeable (typically higher effective stress) layers is generally much lower than in the permeable (typically lower effective stress) layers. Consequently, for conventional hydraulic fracturing, if any of the permeable (typically lower effective stress) layers are not in direct contact with the wellbore, the ability for them to flow is restricted by the low fracture conductivity in an impermeable (typically higher effective stress) layer that is in direct contact with the wellbore.

In multi-layered reservoirs it is common for the effective stress in each of the layers to be different. The magnitude of this difference between adjoining layers is dependent upon many factors, including the depositional environment, the burial history, lithology, pore pressure and fluid movement within each of the layers. In many multi-layered reservoirs the impermeable layers have higher effective stresses than the permeable layers. For conventional hydraulic fracturing, with fracture initiation in a lower effective stress layer, fracture height growth tends to be restricted by higher effective stress in layers above or below the lower effective stress layer used for fracture initiation. With higher effective stress layers above and below the zone of injection, fracture growth is favored towards increasing length, rather than increasing height. The contrast in effective stress is used in the design of the fracture treatments, so as to improve the performance of a targeted lower effective stress formation. In order to apply this approach in a multi-layered reservoir, multiple fracture treatments must be performed, each of which targets specific reservoir layers. Such an approach adds both time and cost to the fracturing process.

For multi-layered reservoirs, techniques have been developed that enable fractures to be initiated in each of the reservoir layers and attempt to improve the efficiency of performing multiple fracture treatments. This approach often still requires reservoir layers to be grouped for an individual fracture treatment, due to constraints of cost and/or time for the fracturing process. All of these techniques require the drilling of a vertical, or deviated, well through all of the layers, followed by the stimulation of individual layers or of groupings of layers.

Horizontal, or high angle, wells are generally used to improve production delivery from a reservoir, with each horizontal well being able to replace a number of conventional vertical, or deviated, wells. To obtain high performance, horizontal, or high angle, wells are often steered to follow the reservoir layer that will be produced and are best applied in reservoirs with good vertical permeability (barriers to vertical flow result in lower performance). Consequently, horizontal, or high angle, wells are not usually applied in multi-layer reservoirs (multi-lateral well technology was developed to allow horizontal, or high angle, wells to be placed in more than one reservoir layer).

SUMMARY OF THE INVENTION

We have found that fracture stimulation of multi-layer reservoirs can be improved by initiating the hydraulic fractures in reservoir layers with higher effective stress (often impermeable layers). It has been found that fractures can be grown through multiple layers (higher effective stress and lower effective stress) allowing a multi-layer reservoir to flow via a single fracture, into a well. The higher effective stress rock used for the initiation of the fracture stimulation treatment is often an impermeable layer. Consequently the well should generally, at least in part, be placed to penetrate a typically impermeable higher effective stress layer, (for example, in shale or in siltstone lying above, below or between crude oil, natural gas or both containing lower effective stress layers).

We have also found that the conductivity near the wellbore, for a fracture initiated in an higher effective stress layer, can be maximized by applying one of several approaches to packing or filling the fracture with proppant, In the first approach, proppant settlement is used to increase the fracture proppant concentration in or near the near wellbore, prior to the fracture closure. In the second approach, high proppant concentrations are pumped towards the end of the fracture treatment so as to pack the zone near the wellbore. In the third approach, one or more subsequent injections of proppant laden fluid into the treated zone are used to increase the near wellbore concentration. In the fourth approach, combinations of any or all three of the approaches are used.

The processes of the disclosed invention are applicable in vertical, deviated and horizontal wells. To those skilled in the art, it will be apparent that the point of fracture initiation no longer has to be within a lower effective stress zone, and that it can be selected to enable development of the required fracture geometry.

One aspect of this invention discloses a hydraulic fracturing process, which comprises drilling a wellbore through at least one reservoir formation, installing in said wellbore at least one conduit, ensuring pressure communication between said wellbore and said reservoir formation, selecting the location of said pressure communication between said wellbore and said reservoir formation for control of said hydraulic fracturing process and pumping a hydraulic fracturing treatment comprising a fracturing fluid and a proppant, at a sufficient pressure via said conduit to create at least one fracture in said reservoir formation.

Another aspect of this invention is a process for increasing conductivity near a wellbore which comprises pumping a hydraulic fracturing treatment comprising a fracturing fluid and a proppant at a sufficient pressure and volume via said conduit to create at least one fracture in said reservoir formation, and reducing, either during or after said pumping step but prior to closing of said fracture, the viscosity of said fracturing fluid to enable said proppant to settle in the fracture at or near said wellbore.

Another aspect of this invention is a process for increasing conductivity near a well-bore, which comprises pumping a first hydraulic fracturing treatment comprising a fracturing fluid and a proppant at a sufficient pressure via said conduit to create at least one fracture in said reservoir formation, and pumping at least another hydraulic fracturing treatment comprising a fracturing fluid and a proppant at a sufficient pressure via said conduit to re-open or to create at least one fracture in said reservoir formation.

Another aspect of this invention is a process for increasing conductivity near a wellbore, which comprises pumping a first hydraulic fracturing treatment comprising a fracturing fluid and a proppant at a sufficient pressure via said conduit to create at least one fracture in a reservoir formation, and reducing, either during or after said pumping step but prior to closing of said fracture, the viscosity of said fracturing fluid to enable said proppant to settle in the fracture at or near said wellbore. At least another hydraulic fracturing treatment comprising a fracturing fluid and a proppant is then pumped at a sufficient pressure via said conduit to re-open or to create at least one fracture in said reservoir formation, either during or after the previous pumping step, but prior to closing of said fracture, the viscosity of said fracturing fluid is reduced to enable said proppant to settle in the fracture at or near said well-bore.

Another aspect of this invention is a process for increasing conductivity near a well-bore, which comprises pumping a first hydraulic fracturing treatment comprising a fracturing fluid and a proppant at a sufficient pressure via said conduit to create at least one fracture in said reservoir formation, and increasing the concentration of the proppant in the fracturing fluid, during said pumping step, and packing the fracture with proppant near the well-bore.

The invention also comprises a method for hydraulically fracturing subterranean formations penetrated from an earth surface by a cased well, at least one formation being a lower effective stress formation and at least one formation being a higher effective stress formation, the method consisting essentially of: establishing fluid communication between an inside of the cased well and a higher effective stress formation; injecting a fracturing fluid into the cased well at a pressure sufficient to force the fracturing fluid into contact with the higher effective stress formation at a pressure sufficient to cause the higher effective stress formation to fracture; continuing injection of the fracturing fluid into the higher effective stress formation at a pressure and in an amount sufficient to cause the fracture in the higher effective stress formation to grow and extend into at least one lower effective stress formation; and, discontinuing the injection of the fracturing fluid.

The invention further comprises a method of producing a fluid from a subterranean formation penetrated from an earth surface by a cased well extending through at least one fluid-bearing lower effective stress formation and a higher effective stress formation, the method consisting essential of: establishing fluid communication between an inside of the cased well and the higher effective stress formation; injecting a fracturing fluid into the well at a pressure sufficient to force the fracturing fluid into contact with the higher effective stress formation at a pressure sufficient to cause the higher effective stress formation to fracture; continuing injection of the fracturing fluid into the higher effective stress formation at a pressure and in an amount sufficient to cause the fracture in the higher effective stress formation to grow and extend into at least one lower effective stress formation; discontinuing the injection of the fracturing fluid; and, producing fluid from the lower effective stress formation.

The invention includes a method for hydraulically fracturing a lower effective stress subterranean formation penetrated from an earth surface by a cased horizontal or deviated well positioned along at least a portion of it's horizontal or deviated length in a higher effective stress formation, the method consisting essential of: establishing fluid communication between an inside of the cased well and the higher effective stress formation at a location along the length of the horizontal or deviated portion of the cased well; injecting a fracturing fluid into the cased well at a pressure sufficient to force the fracturing fluid into contact with the higher effective stress formation at the location at a pressure sufficient to cause the higher effective stress formation to fracture; continuing injection of the fracturing fluid into the higher effective stress formation at a pressure and in an amount sufficient to cause the fracture in the higher effective stress formation to grow and extend into at least one lower effective stress formation; and, discontinuing injection of the fracturing fluid.

The invention also includes a method for producing fluids from a lower effective stress subterranean formation positioned adjacent a higher effective stress horizontal or deviated subterranean formation, penetrated from an earth surface by a cased horizontal or deviated well in the horizontal or deviated formation, the method consisting essentially of: establishing fluid communication between an inside of the cased well and the higher effective stress formation at a location along the length of a horizontal or deviated portion of the cased well; injecting a fracturing fluid into the cased well at a pressure and in an amount sufficient to force the fracturing fluid into contact with the lower effective stress formation at the location at a pressure sufficient to cause the higher effective stress formation to fracture; continuing injection of the fracturing fluid into the lower effective stress formation at a pressure sufficient to cause the fracture in the higher effective stress formation to grow and extend into the lower effective stress formation; discontinuing injection of the fracturing fluid; and, producing fluids from the lower effective stress subterranean formation through the fracture in the higher effective stress formation.

DETAILED DESCRIPTION OF THE INVENTION

This invention provides processes for performing hydraulic fracture stimulation treatments in one or more reservoir formations, where one or more of said formations are intersected by a wellbore in which, most commonly, a casing or liner will have been cemented in place (typically referred to as a "cased hole"). This process comprises a first step of initiating the hydraulic fracture stimulation treatment by first ensuring pressure communication between the wellbore and the subterranean formation by techniques such as perforating the casing at the desired point of communication and thereafter, increasing the wellbore pressure by pressurizing a fracturing fluid in the well to cause the subterranean formation to fracture. Such fracture typically grows in a direction substantially controlled by the effective stresses of said formation. Such a process is described in more detail with the Figures below.

Figure 1:
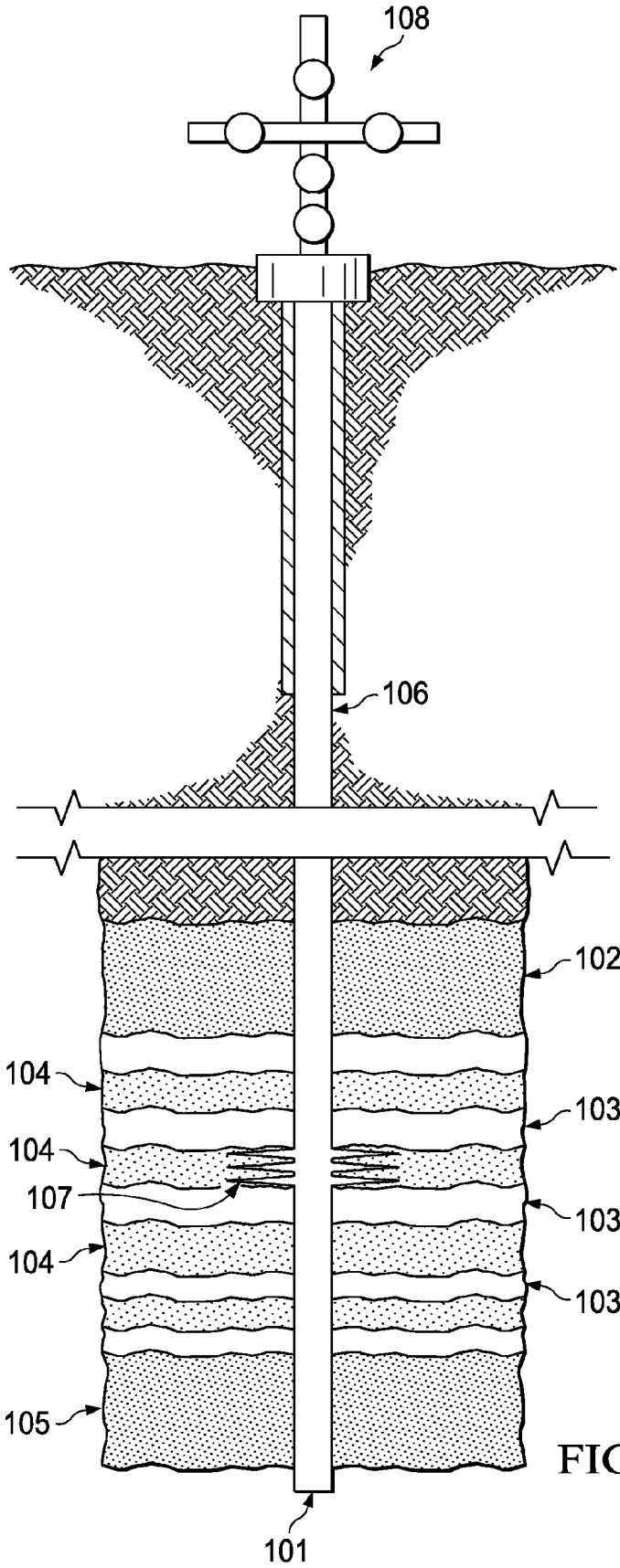
FIG. 1 depicts the general hydraulic fracturing technique techniques as used in this invention.

FIG. 1 illustrates the general hydraulic fracturing techniques as used in this invention. A wellbore 101, is drilled through a multi-layered reservoir. This layered reservoir comprises lower effective stress (hydrocarbon-bearing) layers 103 and higher effective stress (non-hydrocarbon-bearing) layers 104. The number and distribution of these layers varies both within a reservoir and between different reservoirs. The multi-layered reservoir; as shown is bounded above and below by higher effective stress layers 102 and 105. A conduit 106 is installed in the wellbore 101, through which the hydraulic fracture treatment may be pumped. This conduit could be, but is not limited to, production casing, production tubing, coiled tubing or a "frac string" (a temporary conduit specifically designed for fracturing). Packers, or straddle packers may be used along with such conduits to isolate the casing openings at the desired fracture location.

Typically, a casing or liner 106 will be cemented in place in a multi-layered reservoir, and pressure communication with the interval to be fractured, 107, must be re-established prior to pumping the hydraulic fracture stimulation treatment. Methods for re-establishing pressure communication with interval 107 include, but are not limited to, perforating, sand jetting, or the opening of a fracturing valve (installed along with the conduit prior to cementing or along with a temporary "frac string"). An open-hole in the higher effective stress section that itself provides pressure communication with the impervious section shall herein be included as a method of "re-establishing pressure communication with the impervious section." The hydraulic fracture stimulation treatment can then be pumped, through the wellhead 108, down the conduit 106 and into the formation wherever pressure communication with the reservoir, 107, was established. The increase in wellbore pressure, so as to cause the subterranean formation to fracture, is achieved by pumping a fracturing treatment into the well-bore. Such treatment comprises a fracturing fluid typically in combination with a proppant. Any type of fracturing fluid may be used, including (1) oil or water based, (2) oil and water emulsions, (3) carbon dioxide based, or (4) a foamed fluid, containing nitrogen, hydrocarbon or carbon dioxide gas. Said fracturing fluid may contain additives including viscosifiers, cross-linkers, breakers, surfactants, buffers, friction reducers, fluid loss additives and foaming agents. Any type of proppant may be used, including sand, ceramic, bauxite or plastic proppant. The proppant is deployed by mixing it into the fracturing fluid during pumping. To those skilled in the art, the quantities of proppant used, and the timing of the addition of the proppant, are part of the design process and are selected after considering both the planned fracture geometry and the required proppant loading and distribution within the fracture.

Typically the fracturing fluid used is very viscous and may appear gelatinous at ambient temperature. The fracturing fluid typically has a viscosity from about 1 (0.001 MPa·sec.) to about 1,000 cp, (1 MPa·sec.) and more typically from 100 (0.1 MPa·sec.) to 700 cp (0.7 MPa·sec.) and most typically from 200 to 500 cp (0.2 to about 0.5 MPa·sec.).

Figure 2:
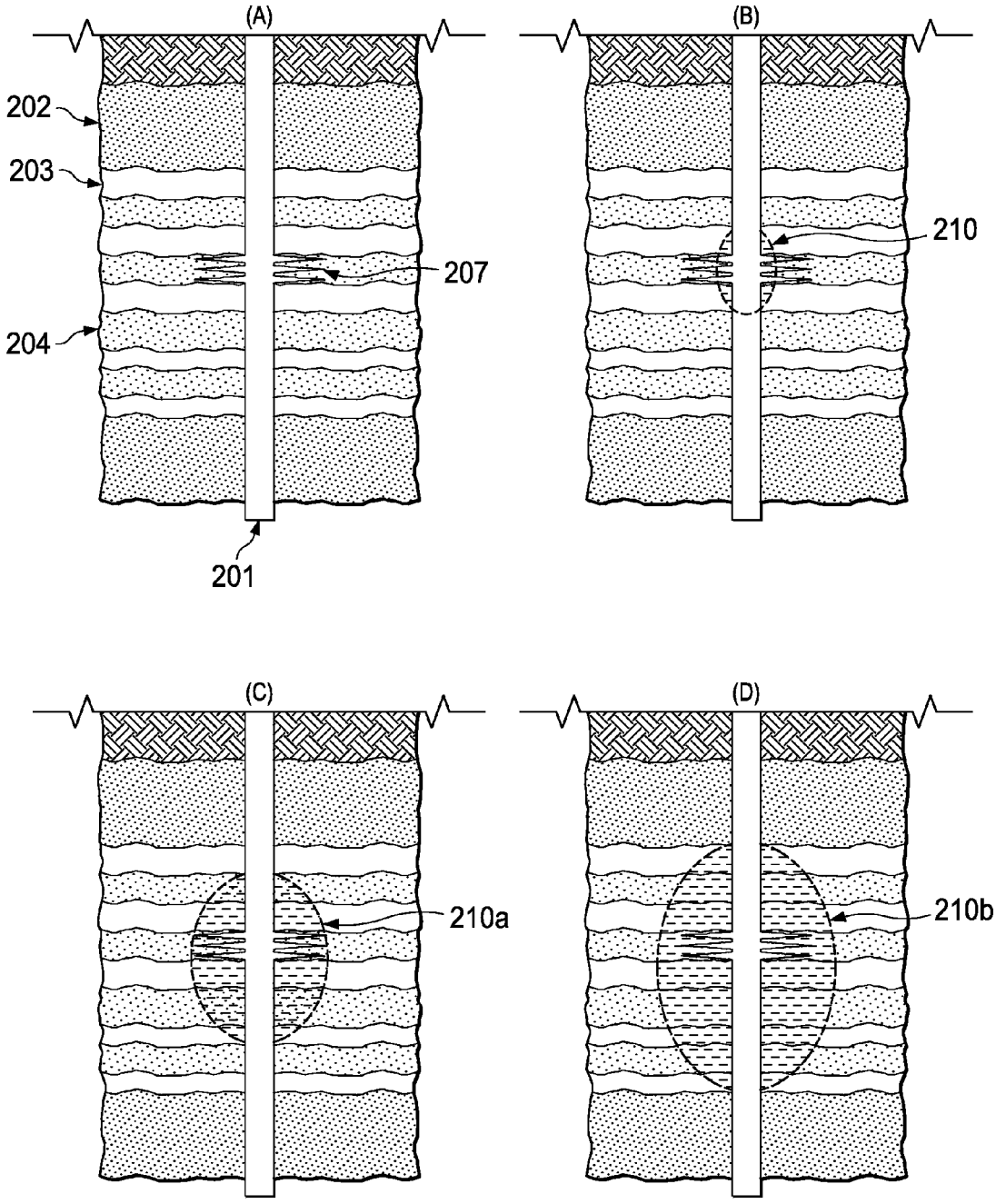
FIG. 2 depicts a cross-sectional view of a hydraulic fracturing stimulation treatment as used in this invention

FIG. 2 illustrates the application of the processes of the disclosed invention. After establishing communication, 207, with the reservoir (frame A) in a higher effective stress layer, 204, high pressure pumping is started. Such pressures are typically less than about 15,000 Psi (103 MPa) and more typically less than about 10,000 Psi (69 MPa). The rapid increase in pressure at the bottom of the well causes the formation rock to fail. It splits, creating a fracture 210, into which the fracturing fluid is pumped. By initiating injection in a higher effective stress layer(s), fracture height growth is not restricted by the stresses in the bounding layer. Consequently significant fracture height growth occurs early in the pumping of the stimulation treatment. As pumping continues, the fracture 210*a* grows, favored towards increasing height, before generation of significant fracture length. This trend continues as more fracturing fluid 210*b* is pumped. During the pumping, "proppant" is added to the fracturing fluid. The timing of addition and the quantity of proppant used is based upon the expected final dimensions of the fracture and the required proppant concentration that will be needed within the fracture to achieve the required production performance. Parts 201, 202, 203 and 204 serve a similar function as those similarly numbered parts for FIG. 1. The amount of fracturing fluid injected is determined based upon the desired size of the fracture.

Figure 3:
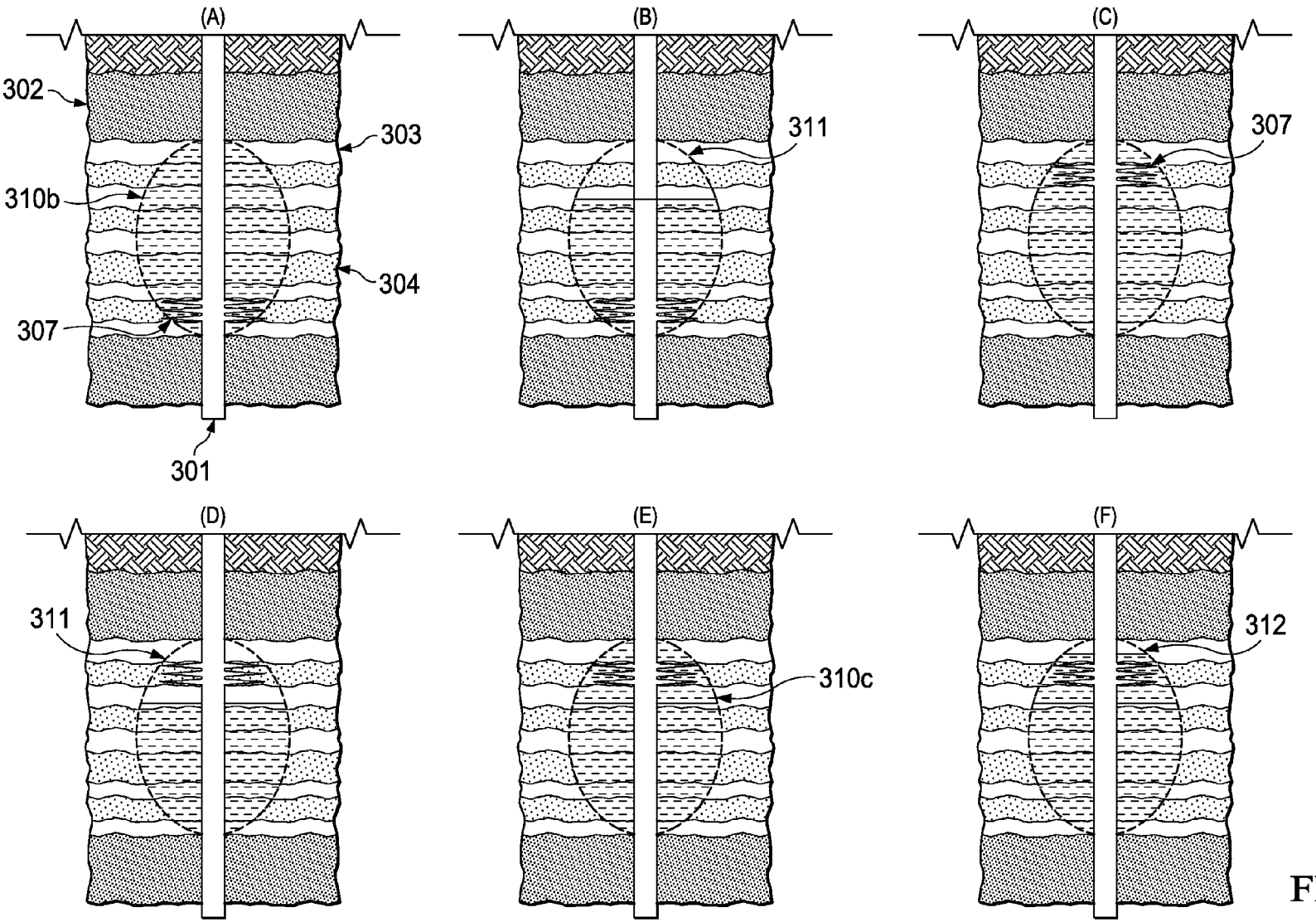
FIG. 3 depicts a process for maximizing near well-bore conductivity after fracture closure.

FIG. 3 depicts processes of the disclosed invention for maximizing near well-bore conductivity after fracture closure. In FIG. 3 the layer used for re-establishing communication 307 with the reservoir (frame A) is in the bottom third of the multi-layered reservoir. During the pumping of the fracture stimulation treatment, or after pumping is complete (but before the fracture closes), the viscosity of the fracturing fluid is reduced so as to induce proppant movement (by settlement and/or convection). This ensures that the proppant concentration near to the point of injection is high, and that the amount of proppant in the fracture generally increases from top to bottom. This results in a region of low proppant concentration in the upper part of the fracture (FIG. 3, frame B, 311). In FIG. 3 the layer used for establishing communication 307 with the reservoir (frame C) is in the top third of the multi-layered reservoir. During the pumping of the first part of fracture stimulation treatment, or after the pumping of the first part is complete (but before the fracture closes), the viscosity of the fracturing fluid is reduced so as to induce proppant movement (by settlement and/or convection). This results in a region of low proppant concentration in the upper part of the fracture (311, frame D). The second part of the fracture stimulation treatment is then pumped, re-filling the upper part of the fracture with proppant (310*c*, frame E). When the pumping of the second part of the fracture stimulation is complete, but before the fracture closes, proppant movement (by settlement and/or convection) is induced, resulting in a region of low proppant concentration in an even higher upper part of the fracture (312, frame F) A third part, or more, may then be pumped, if required to ensure high proppant concentration in the upper part of the fracture. Parts 301, 302, 303, and 304 serve a similar function as those similarly numbered parts for FIG. 1.

Figure 4:
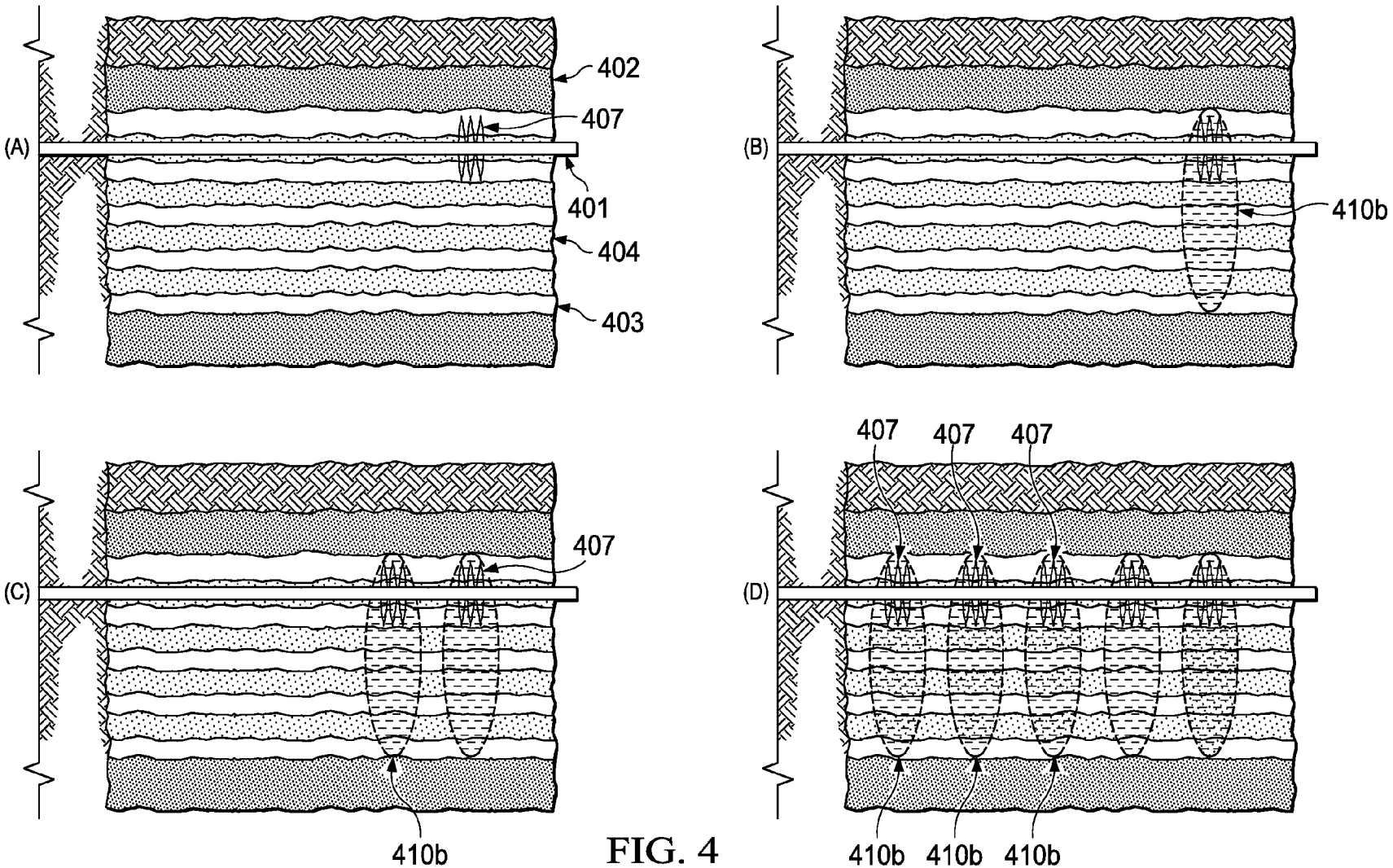
FIG. 4 depicts a process of the invention as applied to high angle and horizontal wells.

The processes of the disclosed invention are applicable in high angle and horizontal wells, as depicted in FIG. 4. After re-establishing a first communication, 407 with the reservoir (frame A) in a higher effective stress layer (404, frame A), a hydraulic fracture stimulation treatment is pumped, creating the first fracture (410*b*, frame B). The first fracture is then isolated, using methods well known to those skilled in the art. For example, a sand plug or a mechanical plug could be placed in the well. If a fracturing valve was used to obtain communication with the reservoir, it can be closed to isolate the fracture. A second communication with the reservoir (407, frame C) is then established in a lower effective stress layer. The hydraulic fracture stimulation treatment is then pumped, creating the second fracture (410*b*, frame C). The second fracture is then isolated, using methods well known to those skilled in the art. This sequence can be repeated for multiple fractures (frame D). Parts 401, 402, 403, and 404 serve a similar function as those similarly numbered parts for FIG. 1.

Figure 5:
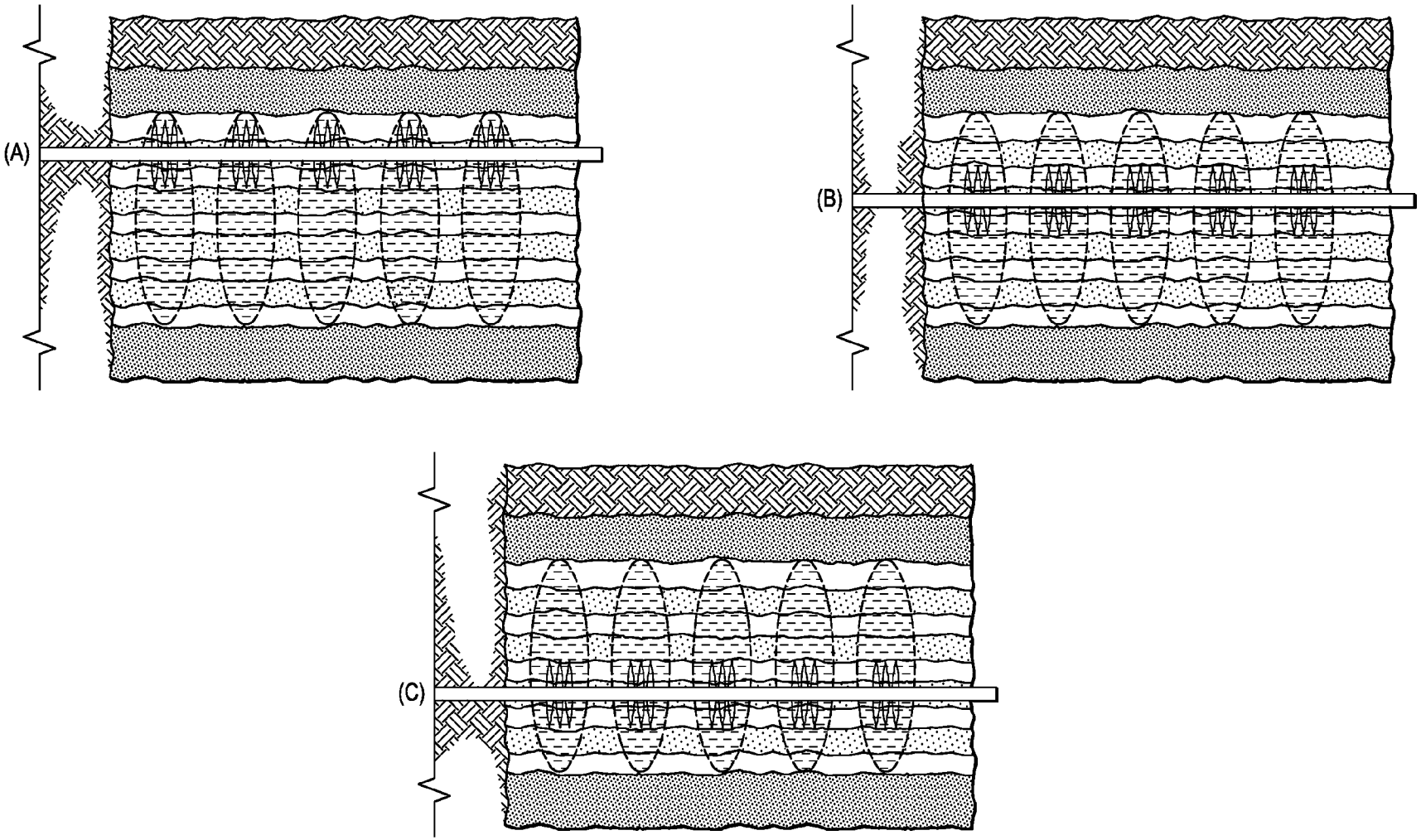
FIG. 5 depicts alternative options for placement of a high angle or horizontal well in a multi-layered reservoir.

FIG. 5 shows alternative options for placement of a high angle or horizontal well in a multi-layered reservoir using the processes of the disclosed invention. The well may be placed anywhere within the multi-layered reservoir (frames A, B and C), the selected location of which impacts the design of the treatment and the selected process or processes for maximizing conductivity near the wellbore.

In the application of this invention, the selection of the zone or zones in which pressure communication is established, within one or more subterranean formations, impacts fracture height growth during the subsequent fracture stimulation treatment. In one aspect of this invention, a zone or zones with predominantly higher than average effective stress within one or more subterranean formations are selected to establish pressure communication. When there is a high effective stress contrast between the selected zone or zones to establish pressure communication and any other zone or zones that require hydraulic fracture stimulation, the process of this invention enables a large increase in height growth. The benefit of a large increase in height growth is important because this allows multiple lower effective stress or producing zones to be connected by a single fracture and, for example, would allow multi-layered reservoirs to be developed with horizontal wells. The processes of the disclosed invention are also applicable in vertical, deviated and horizontal wells.

To those skilled in the art, it will be apparent that the use of this invention allows the point, or points, of fracture initiation to be selected so as to enable a range of fracture geometries (to deliver fracture height growth, extended fracture length or a combination thereof). As examples, the fracture may be initiated in a zone that enables maximum fracture height to be delivered or it could be initiated in a zone that enables the generation of maximum fracture length. The point, or points, of fracture initiation may vary from all being in a zone or zones of high effective stress to predominantly being in a zone or zones of high effective stress, to partly being in a zone or zones of high effective stress.

When applying the processes of this invention, the selected injection point or points for the fracturing fluid and proppant are generally partly or wholly in a zone or zones with higher than average effective stress. When these higher stress zones are largely impermeable, additional processes of this invention provide for increased conductivity in the fracture, near the well-bore. Without such additional processes, the fracture conductivity near to the well-bore may be insufficient, and act as a restriction to the productive potential of the well.

In the first additional process, proppant settlement is used to increase the fracture proppant concentration in the near well-bore region, prior to the fracture closure. In this additional process, the fracture is to be designed to grow above the zone of injection. After pumping of the fracture treatment, but prior to fracture closure, the fracturing fluid viscosity is to be reduced so as to induce proppant settlement towards the point of injection. The viscosity may be reduced to very low levels by the use of fracturing fluids in injection fluids, such as water-containing proppant (about 1 cp) (0.001 MPa·sec.), light oils, water-containing additives and the like and having a low viscosity (less than about 10 cp) (0.01 MPa·sec.).

In the second additional process, high proppant concentrations are pumped towards the end of the fracture treatment so as to pack the zone near the well-bore. By packing the near well bore region, the fracture no longer can close, as it is already filled with proppant. This additional process ensures that proppant is not transported away from near the point of injection after pumping is stopped.

In the third additional process, one or more subsequent injections of proppant laden fluid into the treated zone are used to increase the near wellbore concentration. This additional process does not require the near well-bore conductivity to be optimized during the first injection, and is applicable for both the design of multiple injection treatments and for the restoration of near well-bore conductivity in a previously fractured well. This additional sequential process of fracture filling may be especially applicable in wells where multiple fractures are planned. Stimulation sleeves, which can be opened and closed, and which control where the fracturing fluid is injected may be placed in a well, are placed at or near the selected fracture initiation points in the well. This additional process allows multiple fractures to be placed, while largely eliminating the risk of a screen-out during the main treatment. When a screen-out occurs, proppant can no longer be effectively placed in the fracture, (typically occurring in the latter stages of a fracture treatment when proppant is pumped at high concentration). This results in proppant being left in the well, which is time consuming to remove, adding cost and complexity to multiple stage treatments. By applying the process of this additional process and reducing the risk of screen-outs, the majority of each treatment can be effectively placed and subsequently the near well-bore conductivity can be enhanced by an additional injection stage. Operation of the stimulation sleeves to an open position enable the individual fracture treatments to be placed in the planned fractures, likewise, closing of the sleeves prevent injection.

In the fourth additional process, combinations of any or all three of the additional processes are used.

To those skilled in the art, the viscosity of fracturing fluid and the pumping rate may be varied during the pumping of the fracturing treatment, offering many design options, including control of proppant suspension or settlement, and adjustment to the injection pressure.

To those skilled in the art, it will also be apparent that the use of a combination of viscous transport/suspension and controlled settlement initiated by a change in viscosity, can deliver fracture conductivity, even when the zone being fractured is a higher effective stress zone. The use of settlement to deliver fracture conductivity may be applied in a treatment pumped in a single stage, or in several stages. For example, the quantity of proppant required to deliver fracture conductivity by way of settlement is dependent upon the fracture geometry. All of the required proppant could be deployed during the initial pumping of the fracture treatment. Alternatively, after pumping the initial fracture treatment and allowing proppant settlement, the fracture may not be completely filled. Consequently, a second (or subsequent) proppant stage could be pumped, followed by an additional settling period, so is to increase the propped height within the fracture with effective conductivity. This process may be repeated until the fracture has effective conductivity to the desired propped height.

What is claimed is:

1. A method for hydraulically fracturing subterranean formations penetrated from an earth surface by a cased well, at least one formation being a higher effective stress formation and at least one formation being a lower effective stress formation, the method consisting essentially of:

a) establishing fluid communication between an inside of the cased well and the higher effective stress formation;

b) injecting a fracturing fluid into the cased well at a pressure sufficient to force the fracturing fluid into contact with the higher effective stress formation at a pressure sufficient to cause the higher effective stress formation to fracture;

c) continuing injection of the fracturing fluid into the higher effective stress formation at a pressure and in an amount sufficient to cause the fracture in the higher effective stress formation to grow and extend into at least one lower effective stress formation; and, d) discontinuing the injection of the fracturing fluid.

2. The method of claim 1 wherein after injection of the fracturing fluid a reduced viscosity fracturing fluid containing proppant is injected.

3. The method of claim 1 wherein at least one lower effective stress formation is a permeable formation.

4. The method of claim 1 wherein the at least one lower effective stress permeable formation overlies the higher effective stress formation.

5. The method of claim 1 wherein at least one lower effective stress permeable formation underlies the higher effective stress impermeable formation.

6. The method of claim 1 wherein a lower effective stress permeable formation overlies the higher effective stress formation and wherein a lower effective stress permeable formation underlies the higher effective stress impermeable formation.

7. The method of claim 1 wherein the fracturing fluid contains a proppant.

8. The method of claim 7 wherein the fracturing fluid has a high viscosity.

9. The method of claim 8 wherein the fracturing fluid has a viscosity of at least 200 centipoise (0.2 MPa·sec.).

10. The method of claim 1 wherein a low viscosity fracturing fluid containing a proppant is injected after the injection of the fracturing fluid.

11. A method of producing a fluid from a subterranean formation penetrated from an earth surface by a cased well extending through at least one fluid-bearing lower effective stress level permeable formation and a higher effective stress level formation, the method consisting essentially of:

a) establishing fluid communication between an inside of the cased well and the higher effective stress impermeable formation;

b) injecting a fracturing fluid into the well at a pressure sufficient to force the fracturing fluid into contact with the higher effective stress formation at a pressure sufficient to cause the higher effective stress formation to fracture;

c) continuing injection of the fracturing fluid into the higher effective stress formation at a pressure and in an amount sufficient to cause the fracture in the higher effective stress formation to grow and extend into at least one lower effective stress level fluid-bearing permeable formation;

d) discontinuing the injection of the fracturing fluid; and, e) producing fluid from the lower effective stress formation.

12. The method of claim 11 wherein a reduced viscosity fracturing fluid containing proppant is injected after injection of the fracturing fluid.

13. The method of claim 11 wherein the fluid-bearing lower effective stress formation is an oil-bearing, a gas-bearing or an oil and gas-bearing formation and wherein the fluids produced are crude oil, natural gas or mixtures thereof.

14. A method for hydraulically fracturing a lower effective stress permeable subterranean formation penetrated from an earth surface by a cased horizontal or deviated well positioned along at least a portion of a length of the cased horizontal or deviated well in a higher effective stress level impermeable zone, the method consisting essentially of:

a) establishing fluid communication between an inside of the cased well and the higher effective stress permeable zone at a location along the length of a horizontal or deviated portion of the cased well;

b) injecting a fracturing fluid into the cased well at a pressure sufficient to force the fracturing fluid into contact with the higher effective stress zone at the location at a pressure sufficient to cause the higher effective stress zone to fracture;

c) continuing injection of the fracturing fluid into the higher effective stress formation at a pressure and in an amount sufficient to cause the fracture in the higher effective stress formation to grow and extend into at least one lower effective stress formation; and, d) discontinuing injection of the fracturing fluid.

15. The method of claim 14 wherein after injection of the fracturing fluid a reduced viscosity fracturing fluid containing proppant is injected.

16. The method of claim 14 wherein the injection of the fracturing fluid is continued to extend the fracture to penetrate the lower effective stress permeable formations above or below the higher effective stress zone.

17. The method of claim 14 wherein the fracturing fluid includes a proppant.

18. The method of claim 14 wherein a low viscosity fracturing fluid containing a proppant is injected after injection of the fracturing fluid.

19. The method of claim 18 wherein the fracturing fluid has a viscosity of at least 200 centipoise (0.2 MPa·sec.).

20. The method of claim 14 wherein communication is established between the inside of the cased well and the lower effective stress permeable zone at a plurality of locations along the length of a horizontal or deviated portion of the cased well.

21. The method of claim 20 wherein fractures are formed from a portion of the plurality of locations.

22. A method for producing fluids from a lower effective stress permeable subterranean formation positioned adjacent a higher effective stress impermeable horizontal or deviated subterranean formation, penetrated from an earth surface by a cased horizontal or deviated well in the horizontal or deviated formation, the method consisting essentially of:

a) establishing fluid communication between an inside of the cased well and the higher effective stress formation at a location along the length of a horizontal or deviated portion of the cased well;

b) injecting a fracturing fluid into the cased well at a pressure and in an amount sufficient to force the fracturing fluid into contact with the higher effective stress formation at the location at a pressure sufficient to cause the higher effective stress formation to fracture;

c) continuing injection of the fracturing fluid into the higher effective stress formation at a pressure sufficient to cause the fracture in the higher effective stress formation to grow and extend into at least one lower effective stress formation;

d) discontinuing injection of the fracturing fluid; and, e) producing fluids from the lower effective stress subterranean formation through the fracture in the higher effective stress formation.

23. The method of claim 22 wherein a plurality of fractures are formed at a plurality of locations along the length of the cased well.

24. The method of claim 22 wherein the fluids are natural gas, crude oil or combinations thereof.

25. A method for maximizing the near wellbore conductivity of a fracture in a subterranean formation penetrated by a wellbore in a higher effective stress zone, the method consisting essentially of at least one of:

a) after injection of a fracturing fluid, but prior to closure of the fracture, reducing the viscosity in a proppant-containing fracturing fluid to a viscosity less than about 100 cp (0.1 MPa·sec.) and injecting the reduced viscosity fracturing fluid into the fracture to induce proppant settlement in the fracture near the wellbore;

b) increasing the proppant concentration in the fracturing fluid near the end of the fracturing fluid pumping cycle to position proppant in the fracture near the wellbore when fracturing injection is stopped; and, c) injecting a proppant-laden fluid into the fracture zone subsequent to the injection of the fracturing fluid.

* * * * *